US005135905A

United States Patent [19]

Egashira et al.

[11] Patent Number: 5,135,905

[45] Date of Patent: Aug. 4, 1992

[54] IMAGE-RECEIVING SHEET

[75] Inventors: Noritaka Egashira; Yoshinori Nakamura; Tamami Iwata; Naoto Satake; Takashi Kawasawa; Kiyobumi Ohtake, all of Tokyo, Japan

[73] Assignee: Dai Nippon Insatsu Kabushiki Kaisha, Japan

[21] Appl. No.: 582,217

[22] PCT Filed: Jan. 30, 1990

[86] PCT No.: PCT/JP90/00108

§ 371 Date: Oct. 1, 1990

§ 102(e) Date: Oct. 1, 1990

[87] PCT Pub. No.: WO90/08659

PCT Pub. Date: Aug. 9, 1990

[30] Foreign Application Priority Data

Jan. 30, 1989 [JP] Japan ..... 1-7792
Mar. 2, 1989 [JP] Japan ..... 1-48615
Mar. 7, 1989 [JP] Japan ..... 1-26050[U]

[51] Int. Cl.[5] ..... B41M 5/035; B41M 5/26

[52] U.S. Cl. ..... 503/227; 428/195; 428/409; 428/500; 428/913; 428/914

[58] Field of Search ..... 8/471; 428/195, 409, 428/500, 913, 914; 503/227

[56] References Cited

U.S. PATENT DOCUMENTS 4,837,200 6/1989 Kondo et al. ..... 503/227

FOREIGN PATENT DOCUMENTS 52-143107 11/1977 Japan .
59-85792 5/1984 Japan ..... 428/195
60-110488 6/1985 Japan ..... 428/211
61-172795 8/1986 Japan ..... 428/195
61-258793 11/1986 Japan .
61-283595 12/1986 Japan .
62-21590 1/1987 Japan ..... 503/227
62-101495 5/1987 Japan ..... 503/227
62-189195 8/1987 Japan ..... 428/195
62-198497 9/1987 Japan ..... 428/195
62-177667 11/1987 Japan .

*Primary Examiner*—Bruce H. Hess
*Attorney, Agent, or Firm*—Parkhurst, Wendel & Rossi

[57] ABSTRACT

The present invention relates to an image-receiving sheet used in combination with a heat transfer sheet having a dye layer containing a dye which is melted or sublimated by heating and passed onto said image-receiving sheet, characterized in that a sheet-like substrate (11) includes on its surface a dye-receiving layer (12) for receiving a dye coming from said heat transfer sheet, said dye-receiving layer (12) comprising a copolymer obtained by the copolymerization of (i) vinyl chloride, (ii) an acrylic acid type monomer and (iii) a linear polymer having a vinyl group at an end. The present sheet of such a structure as mentioned above is improved in terms of dyeability and weather-resistance-after-printing, and excels particularly in the storability of printed images.

13 Claims, 4 Drawing Sheets

IMAGE-RECEIVING SHEET

BACKGROUND OF THE INVENTION

1. Field of the Invention

The present invention relates to an image-receiving sheet used in combination with a heat transfer sheet including a dye layer containing a sublimable dye which is to be melted or sublimated by heat and passed onto said image-receiving sheet.

2. Statement of the Prior Art

In some attempts to make images, heat transfer sheets including a dye layer containing a sublimable dispersion dye are heated by a thermal head, and the like, in a dotted pattern corresponding to image signals, thereby passing the dye onto the surfaces of image-receiving sheets.

Such image-receiving sheets comprise a sheet-like substrate and a dye-receiving surface layer formed of polyester resin, and the like, for receiving a dye coming from the heat transfer sheets, thereby giving a clear printed image. A problem with such image-receiving sheets, however, is that although they are of dyeability so improved that distinct images can be obtained, they are poor in weather resistance, as can be appreciated from the discoloration, for example, of the images after printing.

In order to provide a solution to this problem, it has been attempted to improve weather resistance by making use of ultraviolet absorbers, and the like. Such an attempt, however, again poses several problems such as requiring the additional step of incorporating UV absorbers and the resulting cost rise.

The image-receiving sheets, set forth in Japanese Patent Kokai Application Nos. 59(1984)-223425 and 60(1985)-24996, use a vinyl chloride polymer as the dye-receiving layers but, nonetheless, are less than satisfactory in terms of light resistance. The present inventor has already attempted to improve light resistance by using a copolymer of vinyl chloride with an acrylic type monomer as a dye-receiving layer. However, the resulting image-receiving sheet is still less than satisfactory in terms of the improvement in light resistance.

A main object of the present invention is to provide an image-receiving sheet which is free from such drawbacks as mentioned above, and is much more improved in terms of dyeability and weather-resistance-after-printing than conventional ones.

DISCLOSURE OF THE INVENTION

With the above object in mind, the present invention provides an image-receiving sheet used in combination with a heat transfer sheet including a dye layer containing a sublimable dye which is to be melted or sublimated by heat and passed onto it, said image-receiving sheet being characterized in that a sheet-like substrate includes on its surface a dye-receiving layer for receiving a dye coming from said heat-transfer sheet, said dye-receiving layer comprising a copolymer obtained by the copolymerization of (a) vinyl chloride, (b) an acrylic acid type monomer and (c) a linear polymer having a vinyl group at an end.

The present image-receiving sheet of such a structure as mentioned above is improved in terms of not only dyeability and weather-resistance-after-printing but also in the storability of printed images in particular.

BEST MODE FOR CARRYING OUT THE INVENTION

Figure 1:
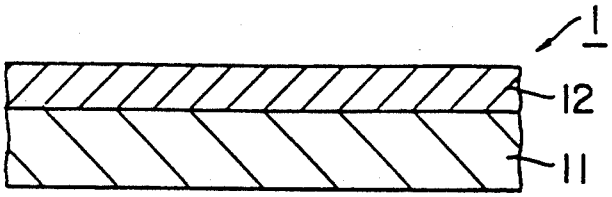
FIG. 1 is a sectional view showing a basic structure of the image-receiving sheet according to the present invention.

As illustrated in the sectional view of FIG. 1, an image-receiving sheet, shown at 1, according to the present invention basically comprises a sheet-like substrate 11 and a dye-receiving layer 12 formed on its surface for receiving a dye coming from a heat-transfer sheet.

The sheet-like substrates used in the present invention may include:

(1) synthetic papers (based on polyolefin, polystyrene, etc.), (2) natural papers such as fine or slick paper, art paper, coated paper, cast-coated paper, paper for lining wall paper, paper impregnated with synthetic resin or emulsion, paper incorporated with synthetic resin, paperboard or cellulose fiber paper, and (3) films or sheets of various plastics such as polyolefin, polyvinyl chloride, polyethylene terephthalate, polystyrene, polymethacrylate and polycarbonate. However, the present invention is in no sense limited to such materials. For instance, use may also be made of white, opaque films obtained by the film-forming of these synthetic resins incorporated with white pigments and fillers or foamed sheets obtained by foaming them. Among others, preference is given to the synthetic papers referred to in (1), since their surfaces have microvoids contributable to low heat conductivity (or, to put it another way, high heat insulating properties). Use may also be made of laminates comprising any desired combination of (1)–(3). Typical examples of the laminates include those of cellulose fiber paper with synthetic papers or cellulose fiber paper with plastic films or sheets. Of these typical laminates, preference is given to those of cellulose fiber paper worth synthetic papers or plastic films, since the thermal instability (inclusive of elongation) of the synthetic papers or plastic films is offset or made up by the cellulose fiber paper, making it possible for the low heat conductivity of the synthetic papers or plastic films to contribute to improvements in the thermal sensitivity to printing. In order to place the two sides of the laminates comprising such combinations in a well-balanced state, preference is given to using a three-layered laminate comprising plastic films/cellulose fiber paper/synthetic papers or plastic films. This can reduce the amount of curling due to printing.

As the synthetic papers or plastic films used for such laminates as mentioned above, use may be made of any material which can be used as the substrate of the image-receiving sheet. Particular preference is given to foamed plastic films such as foamed PP films or synthetic papers including a paper-like layer (e.g., Toyopearl SSP42545 made by Toyobo Co., Ltd.), both having microvoids. The microvoids in the above foamed plastic films, for example, may be formed by stretching the synthetic resins with fine fillers contained in them. When imaging is effected by heat transfer, an image-receiving sheet obtained with the foamed plastic films including the above microvoids gives rise to such effects as an increase in the density of the resulting images and preventing them from becoming rough.

This appears to be achieved, partly because of the microvoids having a heat insulating effect and being highly energy-effective, and partly because of the good cushioning properties of the microvoids making some contribution to the dye-receiving layer on which imaging is to occur. The above microvoid-containing foamed plastic films may be applied directly to the surface of a core material such as cellulose fiber paper.

Besides the cellulose fiber paper, plastic films may also be used as an additional core material in the above laminates. Furthermore, use may be made of laminates of the above cellulose fiber paper with plastic films.

Bonding or otherwise applying the foamed plastic films to the cellulose fiber paper, for instance, may be achieved by using known bonding agents, extrusion laminating or hot bonding. Bonding or otherwise applying the foamed plastic films to the plastic films, for example, may be achieved by laminating or calendering which, at the same time, yields a plastic film. The above bonding means may suitably be selected depending upon the properties of the material to be bonded to the foamed plastic films. Illustrative examples of the bonding agents used are water-soluble adhesives such as emulsion adhesives based .on ethylene/vinyl acetate copolymers or polyvinyl acetate and carboxyl group-containing polyesters. The boding agents for laminating purposes may be organic solvent solution types of adhesives such as polyurethane and acrylic ones. Usually, it is preferred that these substrates have a thickness of about 30 to 200 μm.

The material forming the dye-receiving layer in the present invention should be capable of receiving an image of a dye coming from the heat transfer sheet, e.g., a sublimable dispersion dye, and maintaining an image formed thereby. The present invention is characterized in that the dye-receiving layer is formed by a specific substance which has high dyeability and improved weather resistance.

In the present disclosure, the "specific substance" refers to a copolymer comprising vinyl chloride, an acrylic acid monomer and a linear polymer containing a vinyl group at an end.

As the above acrylic acid type monomer, mention is made of, by way of example alone, acrylic acid; an acrylate such as calcium acrylate, zinc acrylate, magnesium acrylate or aluminium acrylate; an acrylic ester such as methyl acrylate, ethyl acrylate, butyl acrylate, 2-ethylhexyl acrylate, 2-ethoxyethyl acrylate, n-stearyl acrylate, tetrahydrofurfuryl acrylate or trimethylolpropane triacrylate; methacrylic acid; and a methacrylic ester such as methyl methacrylate, ethyl methacrylate, t-butyl methacrylate, tridecyl methacrylate, cyclohexyl methacrylate, triethylene glycol dimethacrylate, 1,3-butylene dimethacrylate or trimethylolpropane trimethacrylate.

Besides the above vinyl chloride and acrylic acid type monomer, other monomers such as acrylonitrile, vinyl pyrrolidone, N-substituted maleimide and maleic acid may be used as comonomers for them. Preferably, the ratio of copolymerization of the other monomers should be in a range of about 0.1 to 30%.

The vinyl group-containing polymer used in the present invention may be a vinyl-modified substance of various linear polymers, each having a vinyl group introduced at its end. Any polymer, if modified by vinyl, may be used. Alternatively, acrylic modifications of linear polymers, each having a vinyl group introduced at its end, may be used.

The above linear polymers may include, by way of example alone, polystyrene, polyacrylonitrile, styrene/acrylonitrile copolymers, polyester, polyvinyl chloride, polyvinyl acetate, vinyl chloride/vinyl acetate copolymers, polyamide and acrylic polymers or copolymers, all having preferably a molecular weight of 1,000 to 15,000.

The copolymer used for the dye-receiving layer of the sheet to be heat-transferred according to the present invention may be obtained by copolymerizing vinyl chloride, the above acrylic acid monomer and the above vinyl group-containing polymer by such methods as emulsion polymerization.

When a vinyl modification of the linear polymer in which its one end is modified by a vinyl group is used as the vinyl group-containing polymer, there is obtained a copolymer of vinyl chloride with the acrylic acid type monomer, to which said linear polymer is further grafted, since said terminated vinyl group takes part in the polymerization involved.

Preferably, the above copolymer, which has preferably a molecular weight of 5,000 to 40,000, comprises 30 to 90 mol % of vinyl chloride, 60 to 5 mol % of the acrylic acid type monomer and 3 to 20 mol % of the vinyl group-containing polymer.

The above copolymer comprising vinyl chloride, the acrylic acid type monomer and the vinyl group-containing polymer may additionally be blended with other resins well-dyeable with a dye. It is understood that such an embodiment is included in the present invention.

The other dyes well-dyeable with a dye may include, by way of example alone, polyester type resin, polycarbonate resin, polystyrene type resin, vinyl acetate resin, AS resin (acrylonitrile/styrene copolymer resin), polyamide resin, epoxy type resin, phenolic type resin, AAS resin (acrylate/styrene/acrylonitrile copolymer resin), polyacetal resin, amino resin, ethylene/vinyl acetate copolymer resin, vinyl chloride/vinyl acetate copolymer resin and polybutadiene resin, which may be used singly or in combination of two or more. As the styrene type resin, vinyl acetate resin and ethylene/vinyl acetate copolymer resin of such well-dyeable resins, use may be made of copolymer resins of their monomers with acrylic acid monomers.

As is conventional in the art, the dye-receiving layer may be formed by coating or printing on the sheet-like substrate a composition for forming the dye-receiving layer, which is obtained by dissolving or dispersing the material forming the dye-receiving layer in a solvent. Alternatively, the dye-receiving layer may be temporarily formed on a carrier provided separately from the sheet-like substrate and, then transferred onto that substrate.

The solvents used in forming such a dye-receiving layer may be ordinary ones, for instance, represented by an alcohol type solvent such as isopropyl alcohol, methyl alcohol, ethyl alcohol and n-butyl alcohol; a ketone type solvent such as methyl ethyl ketone; an aromatic type solvent such as toluene and xylenes; an ester type solvent such as ethyl acetate and butyl acetate; n-hexane; and cyclohexane.

In the present invention, white pigments may be incorporated into the dye-receiving layer with a view to improving its whiteness, thereby enhancing the clearness of the transferred image; imparting ink receptivity to the surface of the sheet to be heat-transferred; and preventing re-transfer of the transferred image. The addition of white pigments makes it possible to achieve the transfer of an image of higher clearness and excelling in heat resistance and humidity resistance. It is also possible to prevent the whiteness and luster of the substrate from being deteriorated by (yellowish) colors inherent in the resins forming the laminates including the dye-receiving and cushioning layers. The addition of white pigments is effective especially when the substrate is formed of natural paper such as cast coated paper, which are inferior in whiteness, luster and smoothness to synthetic papers.

The white pigments may include titanium oxide, zinc oxide, kaolin, clay and so on, which may be used in combination of two or more. Preferably, the amount of the white pigments added is 5 to 50 parts by weight per 100 parts by weight of the resin forming the dye-receiving layer.

In the present invention, the above dye-receiving layer may also contain an ultraviolet absorber to further improve the weather resistance of the dye fixed. The UV absorbers used may be those based on benzophenone, hindered amine, benzotriazole, etc. The amount of the UV absorber added is about 0.05 to 5 parts by weight per 100 parts by weight of the resin forming the dye-receiving layer.

In order to improve the releasability of the image-receiving sheet of the present invention from the heat transfer sheet, the dye-receiving layer may contain a release agent The release agents used may include solid waxes such as polyethylene wax, amide wax and Teflon powders; surfactants such as those based on fluorine and phosphates; silicone oils; and the like. Preference, however, is given to silicone oils.

The above silicone oils should preferably be of the curing type, although it may be in oily form. The curing type of silicone oils are further subdivided into reactive curing, light curing and catalyst types The reactive curing type of silicone oil is preferably a reaction product of amino-modified silicone oil with epoxy-modified silicone oil. Also, the catalyst curing type of silicone oil is preferable. Preferably, the amount of the curing type of silicone oil added is 0.5 to 30 parts by weight per 100 parts by weight of the resin forming the dye-receiving layer.

A solution or dispersion of the above release agent in a suitable solvent may be coated partly or wholly on the surface of the dye-receiving layer and, then, dried to provide a release layer. As the release agent forming the release layer, particular preference is given to the above-mentioned reaction product of amino-modified silicone oil with epoxy-modified silicone oil. The release layer has a thickness of preferably 0.01 to 5 μm, more preferably 0.05 to 2 μm. The release layer may be provided either partly or wholly on the surface of the dye-receiving layer. However, when the release layer is provided on a part of the surface of the dye-receiving layer, it is possible to apply the sublimation transfer recording system in combination with other recording systems, since dot impact recording, thermal recording and recording with pencils, etc. can be applied to another, or release layer-free, part. For instance, sublimation transfer recording is applied to the part with the release layer provided on it, while other recording systems are applied to the part with nothing on it. In the present invention, it is also possible to provide an intermediate layer between the sheet-like substrate and the dye-receiving layer. The intermediate layer may be either a cushioning layer or a porous layer, depending on what material forms it. In some cases, the intermediate layer may serve as a bonding agent.

The cushioning layer is mainly composed of a resin whose 100% modulus — provided by JIS-K-6301 — is at most 100 kg/cm$^2$. It is noted that even when a resin with the 100% modulus exceeding 100 kg/cm$^2$ is used to form the intermediate layer, the heat transfer sheet cannot be kept in full and close contact with the sheet to be heat-transferred during printing This is because the rigidity of such a resin is too high. The lower limit of that 100% modulus is about 0.5 kg/cm$^2$ in practice.

The resins meeting the above-defined condition may include polyurethane resin, polyester resin, polybutadiene resin, polyacrylic ester resin, epoxy resin, polyamide resin, rosin-modified phenolic resin, terpene phenol resin and ethylene/vinyl acetate copolymer resin.

The above-mentioned resins may be used singly or in combination of two or more. Since they are of relatively high viscosity, however, inorganic fillers such as silica, alumina, clay and calcium carbonate or amide type substances such as amide stearate may be added to them when something is wrong with the process involved.

The cushioning layer may be formed by mixing such a resin as mentioned above and, if required, other additives, with a solvent, a diluent and the like to prepare a coating material or ink, and drying it in the form of a coating film by known coating or printing techniques, and may have a thickness of preferably about 0.5 to 50 μm, more preferably about 2 to 20 μm. At a thickness of 0.5 μm, it is too thin to soak up the surface roughness of the sheet-like substrate and so is ineffective. Conversely, a thickness exceeding 50 μm is economically unfavorable, since any improvement in its effect cannot be obtained Moreover, the dye-receiving layer portion becomes so thick that it is difficult to take up the image-receiving sheet or overlay it upon another one.

The provision of such an intermediate layer improves on the close adhesion of the heat transfer sheet to the image-receiving layer, probably because the intermediate layer would be deformed by a pressure occurring during printing due to its own low rigidity. Furthermore, this is presumed to be because such a resin as mentioned above has usually a reduced glass transition point or softening point and is of rigidity which is more reduced than that at normal temperature by heat energy given during printing.

As the porous layer, use may be made of (1) a layer prepared by coating on a substrate a liquid obtained by foaming an emulsion of a synthetic resin such as polyurethane or a rigid rubber latex such as one based on methyl methacrylate/butadiene by mechanical stirring, following by drying; (2) a layer prepared by coating on a substrate a liquid obtained by mixing the above synthetic resin emulsion or the above rubber latex with a foaming agent, followed by drying; (3) a layer prepared by coating on a substrate a liquid obtained by mixing a synthetic resin such as vinyl chloride plastisol or polyurethane or a synthetic rubber such as one based on styrene/butadiene with a foaming agent and foaming it by heating; and (4) a microporous layer prepared by coating on a substrate a mixed liquid of a solution of a thermoplastic resin or synthetic rubber dissolved in an organic solvent with a non-solvent — a solvent composed substantially of water — which is more difficult to evaporate than the organic solvent, compatible with the organic solvent and insoluble in the thermoplastic resin or synthetic resin and drying it, thereby forming a micro-agglomerated film. When a solution for forming the dye-receiving layer is coated and dried on each of the layers (1) to (3), the dye-receiving layer may become irregular on the dried and formed surface due to their large foams. In order to obtain the surface of the dye-receiving layer which is less irregular and on which an image of high uniformity can be transferred, therefore, it is preferable to provide the above microporous layer (4) as the porous layer.

As the thermoplastic resins used to form the above microporous layer, mention is made of saturated polyester, polyurethane, vinyl chloride/vinyl acetate copolymers, cellulose acetate propionate and so on. As the synthetic rubbers for the same purpose, use may be made of those based on styrene/butadiene, isoprene, urethane and so on. The organic solvents and non-solvents used in forming the microporous layer are not critical. Usually, hydrophilic solvents such as methyl ethyl ketone and alcohols may be used as the organic solvents and water as the non-solvents.

Preferably, the porous layer has a thickness of at least 3 μm, more particularly 5 to 20 μm. At a thickness below 3 μm, the porous layer fails to produce cushioning and heat insulating effects.

The substrate may also be provided with a layer on its rear side. In some cases, a number of image-receiving sheets are stacked up and fed one by one for transfer. If the slip layer is provided on each image-receiving sheet, it is then possible to feed image-receiving sheets accurately one by one, since they slip well with each other As the materials for the slip layer, mention is made of methacrylate resins such as methyl methacrylate or the corresponding acrylate resins, vinylic resins such as vinyl chloride/vinyl acetate copolymers and so on.

Also, the image-receiving sheet may contain an antistatic agent. The incorporation of the antistatic agent makes it possible to slip the image-receiving sheets with each other more satisfactorily and is effective for preventing them from being covered with dust. The antistatic may be incorporated into any one of the substrate, dye-receiving layer and slip layer. Alternatively, it may be provided on the rear side of the substrate or somewhere in the form of an antistatic layer. However, preference is given to provide it on the back side of the substrate in the form of an antistatic layer.

According to the present invention, it is also possible to provide a detection mark on the image-receiving sheet. The detection mark is very helpful in positioning the heat transfer and image-receiving sheets, for example. For instance, a detection mark capable of being detected by a phototube detector may be provided by printing on the back side of the substrate or somewhere.

Another preferable embodiment of the sheet-like substrate used in the present invention will now be explained.

Heretofore, synthetic papers or laminate of natural papers with synthetic papers, etc. have generally been used as supports for carrying the resin of dye-receiving layers in image-receiving sheets used with sublimation type thermal transfer systems. However, the image-receiving sheet obtained using synthetic paper as the support is of low rigidity and looks lean or is lacking in richness. This sheet has another disadvantage of giving rise to print curling due to heat after an image has been printed on it.

Such disadvantages as mentioned above are eliminated by using as the support a laminate of a natural paper core with synthetic paper or a foamed plastic film. However, there is an increase in the number of the steps involved and thus, in the cost.

As the image-receiving sheets which are free from such drawbacks as mentioned above or, in other words, are inexpensive, look luxurious and suffer from no print curling, U.S. Pat. No. 4,774,224 specification sets forth an image-receiving sheet .in which a support includes a substrate with a resin extrusion-laminated on it. The surface roughness of the support obtained by coating the resin on the substrate is reduced to 7.5 RaμimAa (about 0.019 μmRa) or lower, whereby the surface of the image-receiving layer is made smooth when a resin layer forming a dye-receiving layer is formed on it, thereby making little difference in gloss between the printed portion made smooth by heat at the time of printing and the non-printed portion and so preventing partial gloss variation from occurring by printing.

However, when the support has very high surface smoothness, as is the case with the image-receiving sheet set forth in the above U.S. patent specification, the dye-receiving resin is so likely to be peeled off the support that the storability of the image-receiving sheet may become worse or it may pass onto the image-receiving sheet during printing (abnormal transfer). By contrast, when the support has a matt surface, the image-receiving sheet including a dye-receiving layer is also made to have a matt surface so that the close adhesion of the support to the image-receiving sheet becomes worse, giving rise to image defects such as dot failure.

According to the present invention, therefore, there can be provided an image-receiving sheet which is inexpensive, luxurious in appearance and is free from print curling, abnormal transfer and a dot failure by use as a support for said image-receiving sheet a laminate which is obtained by extrusion-laminating a resin on a substrate and has a surface roughness lying between 0.2 to 4.0 μmRa.

The above surface roughness refers to a center-line average roughness (Ra) defined by JIS B 0601.

A failure of dots in printed images due to image-receiving sheets having low smoothness becomes noticeable especially when a resin having a relatively high Tg such as polycarbonate is used as the resin forming the dye-receiving layer.

However, a resin having a low Tg of, say, 100° C. or lower, is easily deformable by heat. When such a resin is used as the resin forming the dye-receiving layer, the close adhesion between the image-receiving sheet and the heat transfer sheet is improved. This is because when the image-receiving sheet overlaid on the heat transfer sheet is hot-pressed by a thermal head, and the like, for printing, the image-receiving sheet is plasticized and pressed down by heat and so levelled out. This means that when a resin having a Tg of 100° C. or lower is used as the resin forming the dye-receiving layer, its surface roughness can be made up to some extent.

The above substrate should preferably have sufficient heat resistance to undergo no deformation, decomposition, and the like, when a heated resin is overlaid on it, and may include natural papers such as paperboard, medium duty paper, fine paper, art paper, coated paper, cast coated paper, kraft paper and synthetic resin emulsion impregnated paper; polyolefin films such as those of polyethylene and polypropylene; polyester films such as those of polyethylene terephthalate, polyethylene naphthalate and polycarbonate; halogenated films such as those of polyvinylidene chloride and polyvinylidene fluoride; polysulfone films; polyether films; polyamide films such as those of nylon and aromatic polyamide; aromatic heterocyclic polymer films such as polyimide films; polyxylylene films; aluminum foils; unwoven fabrics; and synthetic resins.

These substrates may contain therein, or be coated on their surfaces with, additives such as sizing agents, anchoring agents, paper enhancers, fillers, antistatics, dyes, fluorescent brighteners, antioxidants and lubricants.

The resins to be extrusion-laminated or otherwise laminated on the substrates should preferably show reduced or limited "neck-in" and relatively superior "drawdown", and may include polyolefin resins such as high-density polyethylene, medium-density polyethylene, low-density polyethylene, polypropylene and ethylene/vinyl acetate copolymers; polyester resins such as polyethylene terephthalate; ionomers resins; nylon; polystyrene; and polyurethane. The resins may be used alone or in admixture, and may be coated on one or both sides of the substrate. For double-side coating, different resins may be used.

The double-side coating of the resin or resins serves to make little difference between both sides of the image-receiving sheet, thus reducing print curling occurring due to heat at the time of printing, environmental curling due to humidity changes, and the like.

The resins to be extruded may contain organic and/or inorganic fillers. The organic fillers may include resinous powders such as those of benzoguanamine, nylon and polycarbonate, while the inorganic fillers may be titanium oxide, zinc oxide, barium oxide, magnesium carbonate, potassium carbonate, alumina, silica, kaolin, clay, silicone powders, graphite and carbon. Particular preference is given to titanium oxide because, when added to the extrusion resin on the side forming the dye-receiving layer, it improves the surface whiteness of that resin. As titanium oxide, use may be made of anatase and/or rutile titanium oxides.

The fillers may be incorporated into the extrusion resin in an amount of 3 to 60%, preferably to 10 to 30%.

In addition, the extrusion resin may contain other additives such as dyes, pigments, fluorescent brighteners, antioxidants, antistatics, lubricants, UV absorbers, heat stabilizers and light stabilizers. It is noted, however, that these additives should preferably have the property of undergoing neither modification nor decomposition while the extrusion resin is melted and coated.

The support for the image-receiving sheet according to the above embodiment should preferably be anchor- or prime-coated so as to increase the adhesion between the substrate and the resin layer to be extrusion-laminated.

Anchor coating may be achieved by coating one or more layers composed of polyester, polyurethane, acrylic polyol or vinyl chloride/vinyl acetate copolymer type resins alone or their mixture, if required, with a reactive curing agent such as polyisocyanate and/or a coupling agent based on silane, or alternatively ion irradation such as corona and plasma treatments, radiation treatments using ultraviolet rays, electron beams, and the like, solvent treatments or flame treatments. For anchor coating, these treatments may be applied singly or in combination.

As the resins for the dye-receiving layer of the image-receiving sheet according to the above embodiment, use may be made of any material which has so far been used for this type of sheets to be heat-transferred. More preferably, however, use is made of a resin having a low Tg of, say, 100° C. or lower, and compatible with the dye.

The support according to the above embodiment has a surface roughness of 0.2 to 4.0 μmRa. This is because at below 0.2 μmRa, its adhesion to the resin of the dye-receiving layer becomes so weak that the image-receiving sheet becomes worse, and when printing is made while it is overlaid on the heat transfer sheet, the resin of the dye-receiving layer is peeled off it by the peel force with which the heat transfer sheet is separated from the dye-receiving layer after printing, and may then pass onto the heat transfer sheet.

At more than 4.0 μmRa, even when the resin of the dye-receiving layer is softened during printing, the surface is not entirely levelled out so that the close adhesion between the sheet to be heat-transferred and the heat transfer sheet becomes insufficient, thus giving rise to defects such as a failure of dots.

In the present invention, regulating the surface roughness of the support to the above-defined specific range, for example, may be achieved by extrusion-laminating the resin and then treating it with a cooling roll having a mirror-finished or embossing surface while its temperature is higher than its Tg. The support having a desired surface roughness may be obtained by making suitable modifications to the mirror-finished or embossing surface of the cooling roll.

Alternatively, the surface of the support may be hot-pressed with a heating roll having a mirror-finished or embossing surface. In this case, the heating roll is regulated to a temperature which is higher than the Tg of the extrusion resin and at which the extrusion resin is not thermally fused together. In order to regulate the surface roughness of the support with higher efficiency, an elastic roll is engaged with the side of the support opposite to its side contacting the heating roll.

Still alternatively, the surface roughness of the support may be regulated by a hot-press plate or sand paper. Thus, the surface roughness of the support may be regulated by any desired means.

Usually, a synthetic resin of high dyeability is generally soft and damage-prone Problems with dye-receiving layers formed of such a resin are that they are damaged or made irregular by various impacts applied to them during transportation or when they are unpacked and placed in cassettes of thermal printers, resulting in a drop or variation of the density of images.

Another problem with the above dye-receiving layers, likely to be stained with fingerprints, oils, and the like, is that they are stained with them when they are unpacked and handled by hand, resulting in deterioration of the image quality.

According to the present invention, the above problems can be solved by providing an assembly of image-receiving sheets, each including a dye-receiving layer on its one side, overlaid one upon another with the dye-receiving layer sides turning in the same direction, in which assembly a protective sheet is placed on at least one dye-receiving layer exposed to view. Such a protective sheet absorbs and cushions impacts applied to the assembly from outside and prevents the assembly from being stained, thus protecting the image-receiving sheets effectively.

The above embodiment will now be explained with reference to the accompanying drawings.

Figure 2:
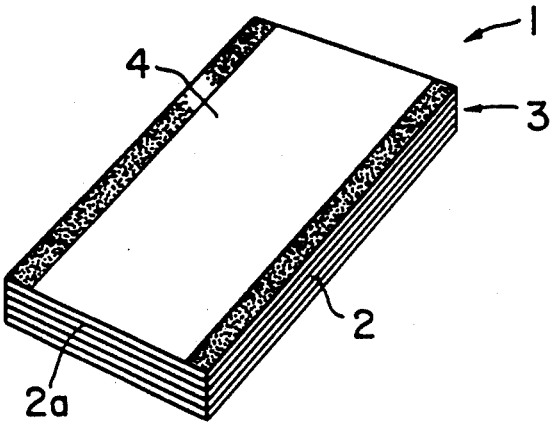
FIG. 2 is a perspective view of the image-receiving sheets (assembly) according to one embodiment of the present invention.

FIG. 2 is a perspective view of one embodiment of the image-receiving sheets according to the present invention. As illustrated in FIG. 2, an image-receiving sheet 1 includes a dye-receiving layer on one side, and a plurality of image-receiving sheets 2 are overlaid one upon another with the dye-receiving layers upward, thus forming an assembly 3. In this assembly 3, a protective sheet 4 is placed on the dye-receiving layer 2*a* of the uppermost image-receiving sheet.

In the embodiment illustrated, the protective sheet 4 is placed on only one side of the assembly 3 (the surface of the dye-receiving layer to be exposed to view). However, it is noted that another protective sheet may be provided on the other side (the lower side in the embodiment illustrated) of the assembly. Alternatively, the image-receiving sheets 2 may be alternately overlaid on the protective sheets 4.

The protective sheet 4 may be formed of synthetic paper such as YUPO TPG made by Oji Yuka Goseishi K. K.; plastic films such as those of polyethylene terephthalate (PET), polyethylene, polypropylene (PP) and low-plasticized vinyl chloride; foamed plastic films such as those of PET and PP containing voids; laminates of films with papers; extrusion-coated (EC) papers; and so on. The protective sheet 4 may also be transparent, semi-transparent or opaque.

Such a protective sheet 4 may contain therein, or be coated on one or both sides thereof with, additives such as antistatics, antioxidants, deoxygenizers and deodorants. It is noted, however, that such additives should not pass onto the dye-receiving layer and so have any adverse influence upon its image formability and storability.

The thickness of the protective sheet 4 may be determined taking account of its rigidity and depending upon the material of which it is formed For instance, the protective sheet 4 may have a thickness of about 75 μm, when it is formed of the aforesaid YUPO TPG.

The size of the protective sheet 4 is usually equal to that of the image-receiving sheet 2 forming the assembly 3, but is not subject to particular restriction. However, it is required to be larger than the area of the region of the image-receiving sheet 2 on which an image is to be formed.

The above protective sheet 4 should not essentially have any adverse influence upon the image formability and storability of the image-receiving layer. One criterion for estimating the suitability of such protective sheets 4 is that after they have been permitted to stand in such a state as shown in FIG. 2 or in a tightly packaged state and in an environment of, e g., 0° C. to 60° C. and 10% to 90% RH for a given length of time, their image formability and the storability of the resulting images are equivalent to those achievable in the absence of the protective sheet 4. If the protective sheet 4 is in such a state as expressed by excessively high surface smoothness, then it is likely to be displaced in the assembly 3. Conversely, if the protective sheet has an irregular surface or low smoothness, then the dye-receiving layer in opposition to it is bruised, or it may be carried with the image-receiving sheet in a thermal printer. Usually, the smoothness of the protective sheet 4 is preferably expressed in terms of its tension (or its coefficient of friction) of about 100 to 500 g. For instance, this tension is measured by placing a 1,500 g weight having a bottom area of 85 $mm^2$ (a load of about 20 $g/mm^2$) on the protective sheet 4 put on the dye-receiving layer of the image-receiving sheet and pulling it horizontally.

Whether or not the protective sheet 4 is provided on its surface with a mark, etc. is not critical, if it is easily distinguishable from the image-receiving sheet. Thus, the protective sheet 4 may be or solid-printed with striped marks (other than a mark by which a thermal printer can distinguish the image-receiving sheet from the protective sheet) parallel to the direction of the image-receiving sheet carried through the thermal printer. Alternatively, it may have nothing thereon at all. Anyway, due to the absence of any given mark on the image-receiving sheet, it is unlikely that the protective sheet 4 will be carried into the thermal printer, even when it is fed into the cassette of the thermal printer.

In the above embodiment, the number of the image-receiving sheets 2 overlaid one upon another to form the assembly 3 is not critical, and so any desired number of them may usually be heat-transferred by heat transfer sheets. Therefore, the protective sheet 4 may be placed on the dye-receiving layer of the image-receiving sheet having one thermal transfer material.

Figure 4:
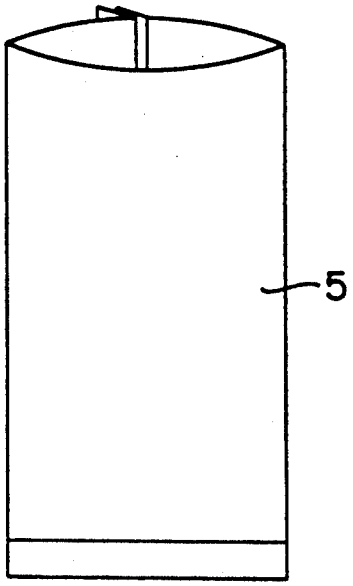
FIG. 4 is a perspective view of a bag.
Figure 3:
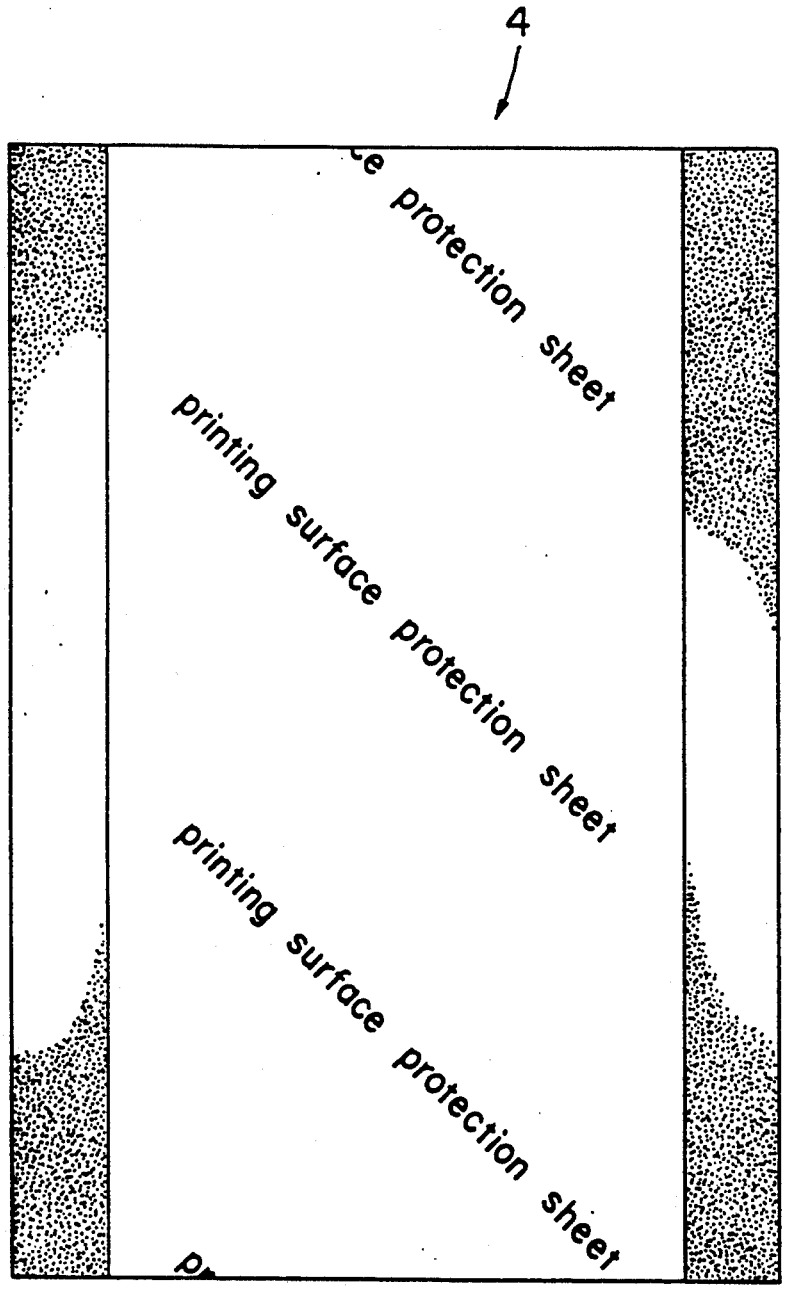
FIG. 3 is a plan view showing one embodiment of the protective sheet.

No particular limitation is imposed upon how to package the thermal transfer material according to the instant embodiment, in which the protective sheet 4 is placed on at least the surface of the assembly 3 on which the dye-receiving layer is exposed to view. For instance, the thermal transfer material may be bundled for storage and transportation. Alternatively, protective sheets 4 may be provided on the top and bottom sides of the assembly 3 and, then, fixed together with adhesive tape. Still alternatively, the thermal transfer material may be put into a bag 5 shown in FIG. 4, by way of example, which is in turn hermetically heat-sealed together at the inner face of its opening edge (see FIG. 5). Such a bag 5 may be formed of, e.g., laminates of aluminium foils/polyethylene films; aluminium foils/paper/polyolefin films; paper/polyolefin films/aluminium foils/polyolefin films; and the like.

Figure 6:
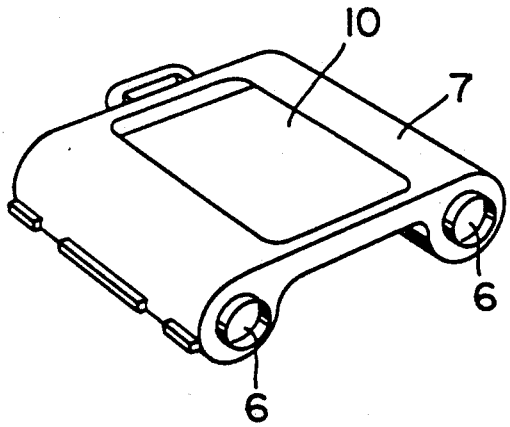
FIG. 6 is a perspective view of one example of the heat-transfer sheet.
Figure 7:
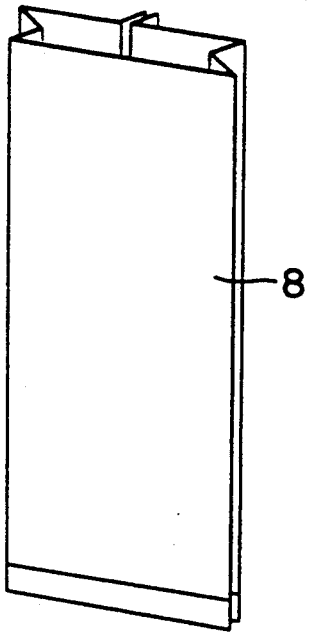
FIG. 7 is a perspective view of a bag.

On the other hand, a heat transfer sheet 10 to be heat-transferred with the above image-receiving sheet is put into a cassette 7 having reels 6 at both ends, as illustrated in FIG. 6. While placed in the cassette 7, the sheet 10 is put into a bag 8, as illustrated in FIG. 7.

Figure 5:
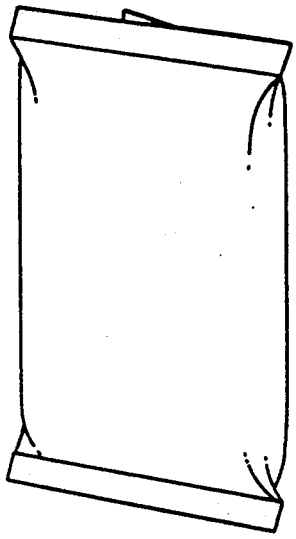
FIG. 5 is a perspective view of the bag into which the image-receiving sheets have ben placed.
Figure 8:
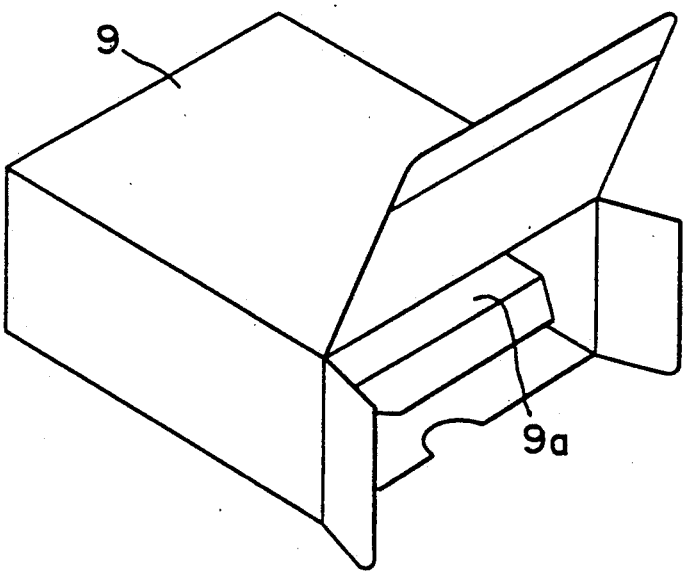
FIG. 8 is a perspective view of a paper box.

Such an image-receiving sheet package as illustrated in FIG. 5, by way of example, and such a heat transfer sheet package as mentioned above are placed in a paper box 9 which is divided by a partition 9*a*, as illustrated in FIG. 8 by way of example, the latter package being placed in the thus defined upper space and the former package in the thus defined lower space for storage and transportation.

In this case, a packing material such as styrofoam may be inserted into a space between the paper box 9 and the image-receiving package in order to prevent the image-receiving sheet from being displaced in the paper box 9 to make displacement between the assembly 3 and the protective sheet 4 in the bag 5.

In using the image-receiving sheets stored and transported in such a package form as mentioned above, the thermal transfer material is unpacked and put into a cassette of a thermal printer. When the thermal printer is of the type that the image-receiving sheet is carried therein with the dye-receiving layer upward, the protective sheet 4 may be disposed of at the same time as it is placed in the cassette. In the case of a thermal printer of the type that the image-receiving sheet is carried therein with the dye-receiving layer downward, on the other hand, the protective sheet 4 remains attached to the lowermost portion of the cassette, so that it can effectively protect the dye-receiving layer of the lowermost image-receiving sheet in the cassette against the irregular bottom of the cassette.

The present invention will now be explained specifically but not exclusively with reference to the following examples and comparative examples in which, unless otherwise noted, "parts" or "%" are given by weight.

Preparation of Heat Transfer Sheet

With a wire bar, an ink composition for a heat-resistant slip layer, composed of such ingredients as stated below, was coated on a 4.5 μm thick polyethylene terephthalate film (Lumilar 5A-F-53 made by Toray Industries, Inc.) and dried by warm air to form a heat-resistant slip layer.

| Ink Composition for Heat-Resistant Slip Layer | |
|---|---|
| Polybutyral resin (Eslex BX-1, made by Sekisui Chemical Co., Ltd., Japan) | 4.5 parts |
| Toluene | 45 parts |
| Methyl ethyl ketone | 45.5 parts |
| Phosphate ester (Plysurf A-208S, made by Daiichi Seiyaku Co., Ltd., Japan) | 0.45 parts |
| 75% ethyl acetate solution of di-isocyanate - Likenate D-110N | 2 parts |

The above film was heated at 60° C. for 12 hours in an oven for curing. After drying, the amount of the ink coated was about 1.2 g. Then, the film was coated on its side opposite to the heat-resistant slip layer with a dye layer composition composed of the following ingredients in an amount of 1.0 g/cmhu 2 on dry basis, and then dried at 80° c. for 5 minutes to obtain a heat transfer sheet.

| Ink Composition for Dye Layer | |
|---|---|
| Dispersion dye (Kayaset Blue 714, made by Nippon Kayaku Co., Ltd., Japan) | 4.0 parts |
| Polyvinyl butyral resin (Eslex BX-1, made by Sekisui Chemical Co., Ltd., Japan) | 4.3 parts |
| Methyl ethyl ketone/toluene (1:1 by weight) | 80.0 parts |

EXAMPLE 1

By roll coating, an ink composition for a dye-receiving layer, having the following composition, was coated on a substrate formed of a 150 μm thick synthetic paper (YUPO-FPG150 made by Oji Yuka Co., Ltd., Japan) at a thickness of 0.3 g/m$^2$ on dry basis to obtain an image-receiving sheet.

| Ink Composition for Forming Dye-Receiving Layer | |
|---|---|
| Graft copolymer resin of vinyl chloride/n-butyl acrylate/vinyl-modified polystyrene (80/10/10) (Denkalac #400 made by Denki Kagaku Kogyo Co., Ltd., Japan) | 70 parts |
| Vinyl chloride/vinyl acetate copolymer (Denka Vinyl #1000A made by Denki Kagaku Kogyo Co., Ltd., Japan) | 30 parts |
| Vinyl-modified silicone (S-62-1212 made by The Shin-Etsu Chemical Co., Ltd., Japan) | 15 parts |
| Silicone crosslinked catalyst (PL 50T made by The Shin-Etsu Chemical Co., Ltd., Japan) | 0.3 parts |
| Methyl ethyl ketone | 200 parts |
| Toluene | 200 parts |

With the heat transfer layer in contact with the dye-receiving layer, such a heat transfer sheet as obtained above was overlaid on each image-receiving sheet, and recording was carried out from the side of the support of the heat transfer sheet by means of a thermal head under the following conditions.

Output of Thermal Head: 1 W per dot,
Pulse Width: 4.0 msec, and
Dot Density: 3 dots/mm The printing density was measured with a densitometer RD-918 made by Macbeth Co., Ltd., U.S.A., and was expressed in terms of relative density wherein the density of Comparative Example 1 was defined as one (1).

After printing, each image-receiving sheet was subjected to weather resistance testing in the following manner. The results are set out in Table 1.

Weather Resistance Testing

The weather resistance testing was performed according to JIS L 0842, and the results were estimated by the following ratings.

◎: the initial fastness according to the second exposure method of JIS L 0841 exceeding the third grade,
○: the third grade or so, and
x: Less than the third degree.

Examples 2–4 & Comparative Examples 1–2

Image-receiving sheets were obtained in the same manners as in Ex. 1, provided that use was made of the following ink compositions for forming dye-receiving layers, and printing was performed with a similar heat transfer sheet in similar manners as in Ex. 1. The results of similar weather resistance testing as in Ex. 1 are also shown in Table 1.

TABLE 1

| Ink Composition for Forming Dye-Receiving Layer (Ex. 2) | |
|---|---|
| Graft copolymer resin of vinyl chloride/n-butyl acrylate/vinyl-modified polystyrene (80/15/5) | 100 parts |
| Epoxy-modified silicone (X-22-3000E made by The Shin-Etsu Chemical Co., Ltd., Japan) | 2 parts |
| Amino-modified silicone (X-22-3050C made by The Shin-Etsu Chemical Co., Ltd., Japan) | 2 parts |
| Methyl ethyl ketone | 200 parts |
| Toluene | 200 parts |
| **Ink Composition for Forming Dye-Receiving Layer (Ex. 3)** | |
| Vinyl chloride/methyl methacrylate/-vinyl-modified AS (80/10/10) copolymer | 100 parts |
| Epoxy-modified silicone (X-22-3000E made by The Shin-Etsu Chemical Co., Ltd., Japan) | 2 parts |
| Amino-modified silicone (X-22-3050C made by The Shin-Etsu Chemical Co., Ltd., Japan) | 2 parts |
| Methyl ethyl ketone | 200 parts |
| Toluene | 200 parts |

TABLE 1-continued (The vinyl-modified AS is a copolymer of acrylonitrile/styrene 880/20) having a molecular weight of about 10,000, said copolymer being a terminal vinyl modification).

Ink Composition for Forming Dye-Receiving Layer (Ex. 4)

| | |
|---|---|
| Copolymer of vinyl chloride/butyl acrylate/vinyl-modified PMMA (70/10/20) | 100 parts |
| Epoxy-modified silicone (X-22-3000E made by The Shin-Etsu Chemical Co., Ltd., Japan) | 2 parts |
| Amino-modified silicone (X-22-3050C made by The Shin-Etsu Chemical Co., Ltd., Japan) | 2 parts |
| Methyl ethyl ketone | 200 parts |
| Toluene | 200 parts |

(The vinyl-modified PMMA is a PMMA having a molecular weight of 12,000, which is modified by a terminal vinyl group).

Ink Composition for Forming Dye-Receiving Layer (Comp. Ex. 1)

| | |
|---|---|
| Polyester resin (Vylon 200 made by Toyobo) | 60 parts |
| Vinyl chloride acetate resin (VYHH UCC) | 40 parts |
| Epoxy-modified silicone (X-22-3000E made by The Shin-Etsu Chemical Co., Ltd., Japan) | 2 parts |
| Amino-modified silicone (X-22-3050C made by The Shin-Etsu Chemical Co., Ltd., Japan) | 2 parts |
| Methyl ethyl ketone | 200 parts |
| Toluene | 200 parts |

Ink Composition for Forming Dye-Receiving Layer (Comp. Ex. 2)

| | |
|---|---|
| Copolymer resin of vinyl chloride/2-hydroxyethyl acrylate/maleic acid = 83.6/16/0.4 moles (Eslex E-C110 made by Sekisui Chemical Co., Ltd., Japan) | 20 parts |
| Epoxy-modified silicone (X-22-3000E made by The Shin-Etsu Chemical Co., Ltd., Japan) | 1.25 parts |
| Amino-modified silicone (X-22-3050C made by The Shin-Etsu Chemical Co., Ltd., Japan) | 1.25 parts |
| Methyl ethyl ketone | 100 parts |
| Toluene | 100 parts |

TABLE 1

| | Relative Dye-Receiving Density | Light Resistance |
|---|---|---|
| Ex. 1 | 1.2 | ◎ |
| 2 | 1.2 | ◎ |
| 3 | 1.2 | ◎ |
| 4 | 1.1 | ◎ |
| Comp. Ex. 1 | 1.0 | X |
| 2 | 1.1 | ○ |

As can be seen from the above results, the image-receiving sheets of the present invention, which have their dye-receiving layers comprised of a specific substance having dyeability and weather resistance, can give very clearly printed images, which are unlikely to be discolored or otherwise deteriorated after printing.

EXAMPLE 5

As a support substrate, P.H.O. White (157 g/m$^2$) made by Fuji Photo Film Co., Ltd. was used. After corona-treated, this substrate was extrusion-coated on the surface to be provided with a dye-receiving layer with an extrusion resin comprising 100 parts of low-density polyethylene and 15 parts of anatase titanium oxide at a thickness of 30 μm. The substrate was further extrusion-coated on the other surface with an extrusion resin comprising 100 parts of low-density polyethylene and 5 parts of an antistatic. Immediately after that, the thus coated substrate was cooled with a solid gravure roll to obtain a support having a center-line average roughness of 0.5 Raμm.

With a wire bar, this support was then coated on its upper surface with an ink composition for forming a dye-receiving layer, having the following composition, in an amount of 6.0 g/cm$^2$ on dry basis, and dried at 120° C. for 10 minutes to obtain an image-receiving sheet.

Ink Composition for Forming Dye-Receiving Layer

| | |
|---|---|
| Polyester resin (Vylon 200 made by Toyobo; Tg = 67° C.) | 11.5 parts |
| Vinyl chloride acetate resin (VYHH made by UCC; Tg = 72° C.) | 5.0 parts |
| Epoxy-modified silicone (X-22-343 made by The Shin Etsu Chemical Co., Ltd., Japan) | 1.2 parts |
| Amino-modified silicone (K-393 made by The Shin-Etsu Chemical Co., Ltd., Japan) | 1.2 parts |
| Methyl ethyl ketone | 50 parts |
| Toluene | 50 parts |

COMPARATIVE EXAMPLE 3

In Example 5, a mirror-finished roll was used as the cooling roll to obtain a support. This support was calendered, while the surface to be provided with a dye-receiving layer was engaged with a mirror-finished roll of 65° C. and the opposite surface with an elastic roll, thereby obtaining a support with the surface having a center-line average roughness of 0.08 μm. This support was provided on its surface with a dye-receiving layer in similar manners as in Ex. 5.

EXAMPLE 6

As a support substrate, the same paper as used in Ex. 5 was employed. After corona-treated, this substrate was extrusion-coated thereon with an extrusion resin comprising 100 parts of high-density polyethylene, 12 parts of anatase titanium oxide and 0.1 part of a fluorescent brightener at a thickness of 25 μm. The substrate was further extrusion-coated on the back side with an extrusion resin comprising 100 parts of high-density polyethylene, 10 parts of silicone powders (Tospearl 130 made by Toshiba Silicone Co., Ltd.) and 0.5 parts of phosphate ester.

With a solid gravure roll, this support was cooled in a similar manner as in Ex. 5, thereby obtaining a support having a center-line average roughness of 1.0 Raμm. This support was provided thereon with a dye-receiving layer in similar manners as in Ex. 1.

COMPARATIVE EXAMPLE 4

A support for a heat transfer sheet obtained in similar manners as in Ex. 6 was allowed to stand at 30° C. and 95% R.H. for 24 hours for wetting. While it was engaged on the side to be provided with a dye-receiving layer with a mirror-finished roll having a surface temperature of 70° C. and on the opposite side with an elastic roll through 100 μm thick PET films, it was calendered at a linear pressure of 200 kg/cm$^2$, thereby obtaining a support having a dye-receiving surface having a surface roughness of 0.05 μmRa. This support was provided thereon with a dye-receiving layer in a similar manner as in Ex. 5.

Comparative Example 5

The same substrate as in Ex. 5 was extrusion-coated with the same extrusion resin, and then cooled with an embossing roll to obtain a support having a surface roughness of 10.0 μmRa. This support was provided thereon with a dye-receiving layer in a similar manner as in Ex. 5.

Comparative Example 6

By carrying out extrusion-coating and cooling with an embossing roll in a similar manner as in Ex. 6, a support having a surface roughness of 12.0 μm was obtained. In a similar manner as in Ex. 5, this support was provided thereon with a dye-receiving layer.

According to JIS K 5400, a grid was provided on each of the image-receiving sheets obtained in Examples 5–8 and Comparative Examples 3–4. In order to test the image-receiving sheet for an adhesive force between the dye-receiving layer and the support, a commercially available cellophane tape (Cellotape® No. 405-1P made by Nichiban Co., Ltd.) was applied on and peeled off it. While the dye-receiving layers were overlaid on the back sides, the obtained image-receiving sheets were tested for storability at 60° C. under a load of 20 g/cm$^2$ for 200 hours. Thereafter, the dye-receiving layers were peeled off the back sides to observe their surfaces visually. The results are set out in Table 2.

Using the image-receiving sheets obtained in Examples 5–8 and Comparative Examples 5–8 in combination with the heat transfer sheet obtained in the aforesaid manners, printing was carried out to observe the failure of dots on the surfaces. The results are set out in Table 3.

EXAMPLE 7

A support having a center-line average roughness of 0.2 Raμm was obtained in similar manners as in Ex. 5, provided that the printing pressure of a solid gravure roll was varied. This support was provided thereon with a dye-receiving layer in similar manners as in Ex. 5.

EXAMPLE 8

While the support obtained in Comparative Example 5 was engaged on the surface to be provided with a dye-receiving layer with a mirror-finished roll having a surface temperature of 65° C. and on the opposite side with an elastic roll, it was again surface-treated by calendering, thereby obtaining a support having a center-line average roughness of 0.38 μm. This support was provided thereon with a dye-receiving layer in similar manners as in Ex. 5.

COMPARATIVE EXAMPLE 7

An image-receiving sheet was obtained by replacing the ink composition used in Ex. 8 by the following one.

| Ink Composition for Forming Dye-Receiving Layer | |
|---|---|
| Polyvinyl butyral resin (BV-5 made by Sekisui Chemical Co., Ltd., Japan; Tg = 110° C.) | 16.5 parts |
| Amino-modified silicone (KF-393 made by The Shin-Etsu Chemical Co., Ltd., Japan) | 1.2 parts |
| Epoxy-modified silicone (X-22-343 made by The Shin Etsu Chemical Co., Ltd., Japan) | 1.2 parts |
| Methyl ethyl ketone/toluene (1/1 by weight) | 100 parts |

COMPARATIVE EXAMPLE 8

A comparative image-receiving sheet was obtained by replacing the ink composition used in Ex. 8 by the following one.

| Ink Composition for Forming Dye-Receiving Layer | |
|---|---|
| Polycarbonate resin (Yupiron 2000E made by Mitsubishi Gas Chemical Company, Inc.) | 15.0 parts |
| Amino-modified silicone (X-22-3050C made by The Shin-Etsu Chemical Co., Ltd., Japan) | 1.2 parts |
| Epoxy-modified silicone (X-22-3000E made by The Shin-Etsu Chemical Co., Ltd., Japan) | 1.2 parts |
| Methylene chloride | 100 parts |

Thermal Transfer Recording

With the above heat transfer and image-receiving sheets, transferred images were recorded by a commercially available color video printer (VY-100 made by Hitachi, Ltd.).

TABLE 2

| | Dye-receiving layer/ support adhesion testing | Storage testing |
|---|---|---|
| Ex. 5 (Ra 0.5 μm) | The grid did not peel off. | No change occurred in the surface of the dye-receiving layer. |
| Ex. 6 (Ra 1.0 μm) | The grid did not peel off. | No change occurred in the surface of the dye-receiving layer. |
| Ex. 7 (Ra 2.0 μm) | The grid did not peel off. | The dye-receiving layer roughened slightly, but any problem did not arise in practice. |
| Comp. Ex. 3 (Ra 0.08 μm) | The grid peeled off partly. | The dye-receiving layer was peeled off the support and adhered to the back side. |
| Comp. Ex. 4 (Ra 0.05 μm) | Peeling occurred from some spots and spread all over the surface. | The dye-receiving layer was peeled off the support and adhered to the back side. |

TABLE 3

| | Printing tests |
|---|---|
| Ex. 5 (Ra 0.5 μm) (Resin of dye-receiving layer having Tgs of 67/72° C.) | Nice image was obtained with no failure of dots on printed portions of high to low density. |
| Ex. 6 (Ra 1.0 μm) (Resin of dye-receiving layer having Tgs of 67/72° C.) | Nice image was as a whole obtained with only a slight failure of dots on a printed portion of low density. |
| Ex. 8 (Ra 0.38 μm) (Resin of dye-receiving layer having Tgs of 67/72° C.) | Nice image was as a whole obtained with only a slight failure of dots on a printed portion of low density. |
| Comp. Ex. 5 (Ra 10.0 μm) (Resin of dye-receiving layer having Tgs of 67/72° C.) | Many failures of dots were found on printed portions of medium to low density. |
| Comp. Ex. 6 (Ra 12.0 μm) (Resin of dye-receiving layer having Tgs of 67/72° C.) | Many failures of dots were found on printed portions of high to low density. |
| Comp. Ex. 7 (Ra 0.38 μm) (Resin of dye-receiving layer having Tg of 110° C.) | Many failures of dots were found on printed portion of low density. |
| Comp. Ex. 8 (Ra 0.38 μm) (Resin of dye-receiving layer having Tg of 140° C.) | Many failures of dots were found on printed portion of low density. |

INDUSTRIAL APPLICATIONS

The image-receiving sheets of the present invention are applicable to: (1) forming photographs of faces for expedient ID cards, (2) forming photographs of faces for name cards, (3) illustrating telephone cards with pictures, (4) premia, (5) post cards, (6) window advertisements, (7) decorative illuminators, (8) various ornaments, (9) tags, (10) labels for goods instruction, (11) labels for writing materials, (12) indices for audio or video cassettes, (13) sheets for preparing transmission type of MSS, and so on.

We claim:

1. An image-receiving sheet used in combination with a heat transfer sheet having a dye layer containing a dye which is melted or sublimated by heating and passed onto said image-receiving sheet, said image-receiving sheet comprising:

a substrate, and a dye-receiving layer formed on said substrate for receiving a dye transferred from said heat transfer sheet, said dye-receiving layer comprising a copolymer obtained by the copolymerization of (i) vinyl chloride, (ii) an acrylic acid monomer and (iii) a linear polymer having a vinyl group at an end.

2. An image-receiving sheet as claimed in claim 1, wherein said linear polymer having a vinyl group at an end is a vinyl-modified polymer in which at least one end thereof is substituted by a vinyl group.

3. An image-receiving sheet as claimed in claim 1, wherein the copolymer forming said dye-receiving layer is a graft copolymer in which said linear polymer is grafted to a main chain of said copolymer.

4. An image-receiving sheet as claimed in claim 1, wherein said linear polymer having a vinyl group at an end comprises polystyrene 5. An image-receiving sheet as claimed in claim 1, wherein said linear polymer having a vinyl group at an end comprises a styrene/acrylonitrile copolymer.

6. An image-receiving sheet as claimed in claim 1, wherein said linear polymer having a vinyl group at an end comprises a polyvinyl chloride.

7. An image-receiving sheet as claimed in claim 1, wherein said linear polymer having a vinyl group at an end comprises a copolymer of polyvinyl chloride with vinyl acetate.

8. An image-receiving sheet as claimed in claim 1, wherein said linear polymer having a vinyl group at an end comprises a monomer or copolymer of an acrylic acid monomer.

9. An image-receiving sheet as claimed in claim 1, wherein said dye-receiving layer comprises a composition of said copolymer further blended with other resin.

10. An image-receiving sheet as claimed in claim 1, wherein an intermediate layer is provided between said sheet-like substrate and said dye-receiving layer.

11. An image-receiving sheet as claimed in claim 1, wherein the surface of said substrate has a center-line average roughness of 0.2 to 4.0 μmRa.

12. An image-receiving sheet as claimed in claim 1, wherein said substrate comprises a laminate obtained by extrusion-laminating a resin on the surface of a substrate material.

13. An image-receiving sheet as claimed in claim 12, wherein said resin to be extrusion-laminated contains an organic and/or inorganic filler.

* * * * *